US006079123A

United States Patent [19]

Clark

[11] Patent Number: 6,079,123

[45] Date of Patent: Jun. 27, 2000

[54] SELF-VENTILATING INSERT FOR FOOTWEAR

[75] Inventor: Gregory Clark, Weston, Conn.

[73] Assignee: Breeze Technology, Las Vegas, Nev.

[21] Appl. No.: 09/162,188

[22] Filed: Sep. 28, 1998

Related U.S. Application Data

[60] Provisional application No. 60/089,321, Jun. 15, 1998.

[51] Int. Cl.[7] ..... A43B 7/06

[52] U.S. Cl. ..... 36/3 B; 36/3 R; 36/29

[58] Field of Search ..... 36/3 R, 3 B, 27, 36/28, 29

[56] References Cited

U.S. PATENT DOCUMENTS

| | | | |
|---|---|---|---|
| 1,660,698 | 2/1928 | Williams, Sr. . | |
| 1,932,557 | 10/1933 | Meucci . | |
| 2,086,790 | 7/1937 | Wroten . | |
| 2,354,407 | 7/1944 | Shaks . | |
| 2,442,026 | 5/1948 | Thompson, Jr. . | |
| 2,604,707 | 7/1952 | Hicks . | |
| 2,741,038 | 4/1956 | Eliassen . | |
| 3,029,530 | 4/1962 | Eaton . | |
| 3,128,566 | 4/1964 | Burlison et al. | 36/3 R |
| 3,180,039 | 4/1965 | Burns, Jr. | 36/3 R |
| 3,284,930 | 11/1966 | Baldwin . | |
| 3,331,146 | 7/1967 | Karras . | |
| 3,475,836 | 11/1969 | Brahm | 36/3 B |
| 4,445,284 | 5/1984 | Sakutori . | |
| 4,592,153 | 6/1986 | Jacinto | 36/27 |
| 4,602,441 | 7/1986 | El Sakkaf . | |
| 4,654,982 | 4/1987 | Lee . | |
| 4,776,110 | 10/1988 | Shiang . | |
| 4,813,160 | 3/1989 | Kuznetz . | |
| 4,835,883 | 6/1989 | Tetrault et al. . | |
| 4,888,887 | 12/1989 | Solow . | |
| 4,974,342 | 12/1990 | Nakamura . | |
| 4,993,173 | 2/1991 | Gardiner . | |
| 4,999,931 | 3/1991 | Vermeulen . | |
| 5,010,661 | 4/1991 | Chu . | |
| 5,068,981 | 12/1991 | Jung . | |
| 5,195,254 | 3/1993 | Tyng . | |
| 5,282,324 | 2/1994 | Cheng . | |
| 5,333,397 | 8/1994 | Haush . | |
| 5,341,581 | 8/1994 | Huang | 36/3 B |
| 5,408,760 | 4/1995 | Tse et al. . | |
| 5,477,626 | 12/1995 | Kwon . | |
| 5,515,622 | 5/1996 | Lee . | |
| 5,606,806 | 3/1997 | O'Dwyer . | |
| 5,675,914 | 10/1997 | Cintron . | |
| 5,697,170 | 12/1997 | Murrell et al. . | |
| 5,860,225 | 1/1999 | O'Dwyer | 36/27 |

FOREIGN PATENT DOCUMENTS

| | | | |
|---|---|---|---|
| 579284 | 7/1959 | Canada . | |
| 350103A2 | 1/1990 | European Pat. Off. . | |
| 925961 | 9/1947 | France . | |
| 2670369 | 6/1992 | France | 36/3 B |
| 118546 | 6/1900 | Germany . | |
| 532953 | 9/1955 | Italy . | |
| 1320329 | 6/1973 | United Kingdom | 36/3 B |
| 2165439A | 4/1986 | United Kingdom . | |
| 2189679A | 11/1987 | United Kingdom . | |
| 2240254A | 7/1991 | United Kingdom . | |
| 2245145A | 1/1992 | United Kingdom . | |
| WO 87/03789 | 7/1987 | WIPO . | |
| WO 93/09994 | 5/1993 | WIPO . | |

OTHER PUBLICATIONS

Japanese Patent Abstract of Japanese Patent No. 2–283,296 to Chisso Corporation, published on Nov. 20, 1990.

Japanese Patent Abstract of Japanese Patent No. 3–001,805 to Hayabe, published on Jan. 8, 1991.

*Primary Examiner*—M. D. Patterson

*Attorney, Agent, or Firm*—Crowell & Moring LLP

[57] ABSTRACT

The present invention is a self-ventilating insert for footwear with a wedge-shape pumping chamber located in the heel of the footwear. The pumping chamber can displace an air volume of at least about 44 cubic centimeters plus 3 times the U.S. men's footwear size. The pumping chamber has convex side and rear walls that fold together as the pumping chamber collapses. Maximum air circulation is achieved as the upper and lower surfaces of the pumping chamber come into full contact with each other. In a preferred embodiment, the length of the pumping chamber is between 30% and 60% of the length of the sole. The internal air duct, in a preferred embodiment, has a thin, wide cross-section with a plurality of tubes that resist kinking and pinching action near the flex zone of the footwear.

22 Claims, 6 Drawing Sheets

SELF-VENTILATING INSERT FOR FOOTWEAR

The present application claims priority from the filing date of Jun. 15, 1998, of U.S. Provisional Patent Application Serial No. 60/089,321.

FIELD OF THE INVENTION

This invention relates to ventilated footwear having a pumping chamber in the heel of the shoe.

BACKGROUND OF THE INVENTION

Ventilation, i.e., the removal of excess heat and moisture from within the footwear, is one of the few areas where performance of modern footwear that remains unsatisfactory. Although there is an extensive prior art concerning the forced air ventilation of footwear, typical forced air ventilation systems are costly and difficult to manufacture, have poor durability, or are otherwise incapable of circulating a sufficient amount of air to cool the wearer's foot effectively.

To reduce the cost and difficulty in footwear having a forced air ventilation system, ventilated footwear been proposed in which the entire ventilation system is incorporated in a removable insole. Such ventilating insoles are disclosed in U.S. Pat. No. 3,331,146 (disclosing a chamber in the heel of an insole with duct leading into the front of foot and a second duct rising above the foot-enclosing upper); U.S. Pat. No. 4,776,110 (disclosing an insole with a chamber in the heel, multiple distribution channels and an air guide for exchanging air through the side of the foot-enclosing upper); U.S. Pat. No. 5,068,981 (disclosing a heel chamber incorporating a mechanical spring and ducts configured to vent through the side walls of the foot-enclosing upper); U.S. Pat. No. 5,195,254 (disclosing a molded insole and an assisting "blast device"); and U.S. Pat. No. 5,333,397 (disclosing a kidney-shaped air clamber position at the rear and inner periphery of the insole). Such insoles with ventilation system, however, have several intrinsic disadvantages such as:

(1) the volume of air that can be circulated by an insole device is severely limited by the thickness of the insole;

(2) the periodic compression of the insole pump requires the wearer's foot to move vertically relative to the interior sides of the footwear, resulting in friction, irritation, and possible blisters;

(3) the re-circulation of the air contained within the footwear provides little long-term benefit, and the process itself may even cause the interior temperature to rise;

(4) insoles adapted to exchange air with the external environment are complex and often affect the design, manufacture, and aesthetic aspects of the footwear; and (5) the space and material limitations of the insole design result in a rapid degradation of their cushioning and air-pumping capabilities.

Another footwear ventilation system embeds the ventilation system in the sole structure of footwear with relatively thick, resilient midsole components. U.S. Pat. No. 5,515,622 discloses a ventilation system comprised of numerous separate components in the midsole of an athletic footwear. Although this approach allows for larger pumped air volumes and eliminates some friction, this approach also complicates the manufacturing of the footwear. Furthermore, for practical reasons the pumped air volume is significantly limited to about 20 cubic-centimeters (cc) that is insufficient to cool the wearer's foot effectively. U.S. Pat. No. 5,010,661 also disloses a ventilation system in the sole of a shoe, in this case a unidirectional ventilation sytem in which air is pumped into a cavity in the heel of the shoe, and then pumped out through outlets in the front part of the shoe.

A third improvement to footwear ventilation system is a hybrid of the two approaches described above. For example, U.S. Pat. No. 5,408,760 discloses a removable molded device comprising a small compressible air chamber and two non-return valves fitted into a cavity in the sole under the wearer's forefoot. Pumped air volume in this configuration, however, remains quite small and thus incapable of cooling the wearer's foot effectively.

As described above, there is still an unsatisfied need for a simple forced air ventilation system that is inexpensive and easy to manufacture, durable, and capable of pumping sufficient air to effectively cool a person's feet.

SUMMARY OF THE INVENTION

The present invention is a self-ventilating insert for footwear having a pumping chamber near the heel region. The pumping chamber has a wedge-shaped longitudinal cross-section, that is highest towards the rear of the foot and tapers forward to a minimum thickness in front of the wearer's heel but behind the flex zone at the ball of the foot. The pumping chamber has convex side and rear elbow-shaped walls that fold together as the pumping chamber is compressed. The flex points at the outer extremities of the elbows are reinforced with fillets. The fillets help push the top and bottom of the pumping chamber apart when the foot is off the ground, such that the pumping chamber returns to its expanded shape when it is no longer under compression.

The entire insert can be fabricated as a single blow-molded part (except for the valves which have to be added to the part). The use of blow molding results in the formation of the fillets in the elbows of the chamber, which serve to bias the top and bottom of the chamber apart, as discussed above.

As shown in FIG. 1, in a preferred embodiment of the invention, an air inlet is located near the toe region of the insert so that outside air can be drawn into the footwear to ventilate the toe region of the foot. An internal air duct extends from the air inlet to the pumping chamber in the heel of the shoe through a first non-return valve. An external air vent, for exhausting air during compression of the pumping chamber, is located near the leading edge or along the peripheral walls (i.e., at the instep or at the rear) of the pumping chamber. A second non-return valve in the external air vent allows air to be exhausted from the pumping chamber but prevents outside air from being drawn into the pumping chamber.

A preferred embodiment of the invention is shown in FIG. 2. FIGS. 2 and 3 show the wedge-shape longitudinal cross-section of the pumping chamber, as well as its convex side and rear walls. When the pumping chamber is compressed, the walls of the pumping chamber fold together (pushing the outside edge of the pumping chamber further outward) as the upper and lower surfaces of the pumping chamber come into contact with each other. The pumping chamber has converging upper and lower peripheral wall portions extending down and up, respectively, from the upper and lower surfaces of the pumping chamber. The leading end of the pumping chamber has a forwardly elongated wedge shape, and the side and rear walls of the pumping chamber form a shallow wedge.

When the foot is on the ground, and the pumping chamber is compressed and the height of the heel of the footwear is essentially the same as with ordinary footwear. When the foot is elevated, the pumping chamber expands, and the height of the heel of the footwear is much greater than with ordinary footwear, but (because the foot is in the air) that has no effect on the comfort or stability of the shoe.

In the preferred embodiment of the invention, air is provided to the pumping chamber via a one-way inlet valve located in the toe or bridge-of-the-toe region. As the pumping chamber expands, air is drawn through the inlet valve to the pumping chamber, and the air in the toe region of the foot is replaced by air from outside the footwear. A plurality of small resilient tubes positioned side by side form the internal air duct connecting the inlet valve to the pumping chamber. The small diameter of the tubes allows them to flex without collapsing as they pass through the flex zone.

The insert is preferably placed between the upper and the midsole as shown in FIG. 6. It is also preferable that the thickness of the pumping chamber walls be in the range of 0.5 to 0.8 mm, and that it be made of an impervious resilient material such as a polyurethane or ethylenevinyl acetate (EVA) rubber. Should the peripheral walls of the pumping chamber be exposed, the walls may have to provide a cushioning function in which case a thicker wall up to 2 mm thick may be desirable.

The pumping chamber can displace a volume that is at least about 44 cubic centimeters (cc) plus 3 times the shoe size. For example, for an U.S. size 9 men's shoe, the pumping chamber may pump at least about 71 cc (44 cc+3×9 cc) of air. In a preferred embodiment, the length of the pumping chamber is in the range of 30% to 60% of the length of the footwear. When fully compressed, the pumping chamber has a volume that approaches zero.

In a preferred embodiment, the internal air duct has low bending moment and has a thin wide cross-section as shown in FIG. 4. Preferably, the internal air duct has a plurality of small diameter tubes with that allows them to flex without collapsing in the flex zone.

The ventilation means of the present invention also may be adapted to induce a warming effect by reversing the air flow direction. Fresh air from the footwear exterior is sucked into the pumping chamber. The air is then heated due to the compression of the pumping chamber. The warmer air is then introduced into the footwear interior. The alternative cooling or warming effect can be achieved simply by choosing the direction of the non-return valves.

OBJECTS OF THE INVENTION

It is an object of the present invention to provide a single pumping chamber that can be easily incorporated into footwear, and that performs all of the functions necessary to provide forced air ventilation to the interior of the footwear.

It is a further object of this invention that the single pumping chamber will be low cost, be easy to manufacture, and require minimum alteration to footwear fabrication techniques.

It is a still further object of this invention that the pumping chamber will be as durable as the normal sole construction materials.

It is yet another further object of this invention that the pumping chamber will provide a large volume of airflow and to effectively cool the wearer's foot.

DESCRIPTION OF THE DRAWINGS

FIG. 2-*a* is a schematic diagram of the longitudinal cross-section of the present invention in a different embodiment along Line A—A in FIG. 1.

FIG. 5-*b* illustrates the rotation of the cross-section of the peripheral walls as the pumping chamber comes to the collapsed position.

DETAILED DESCRIPTION OF THE INVENTION

Figure 1:
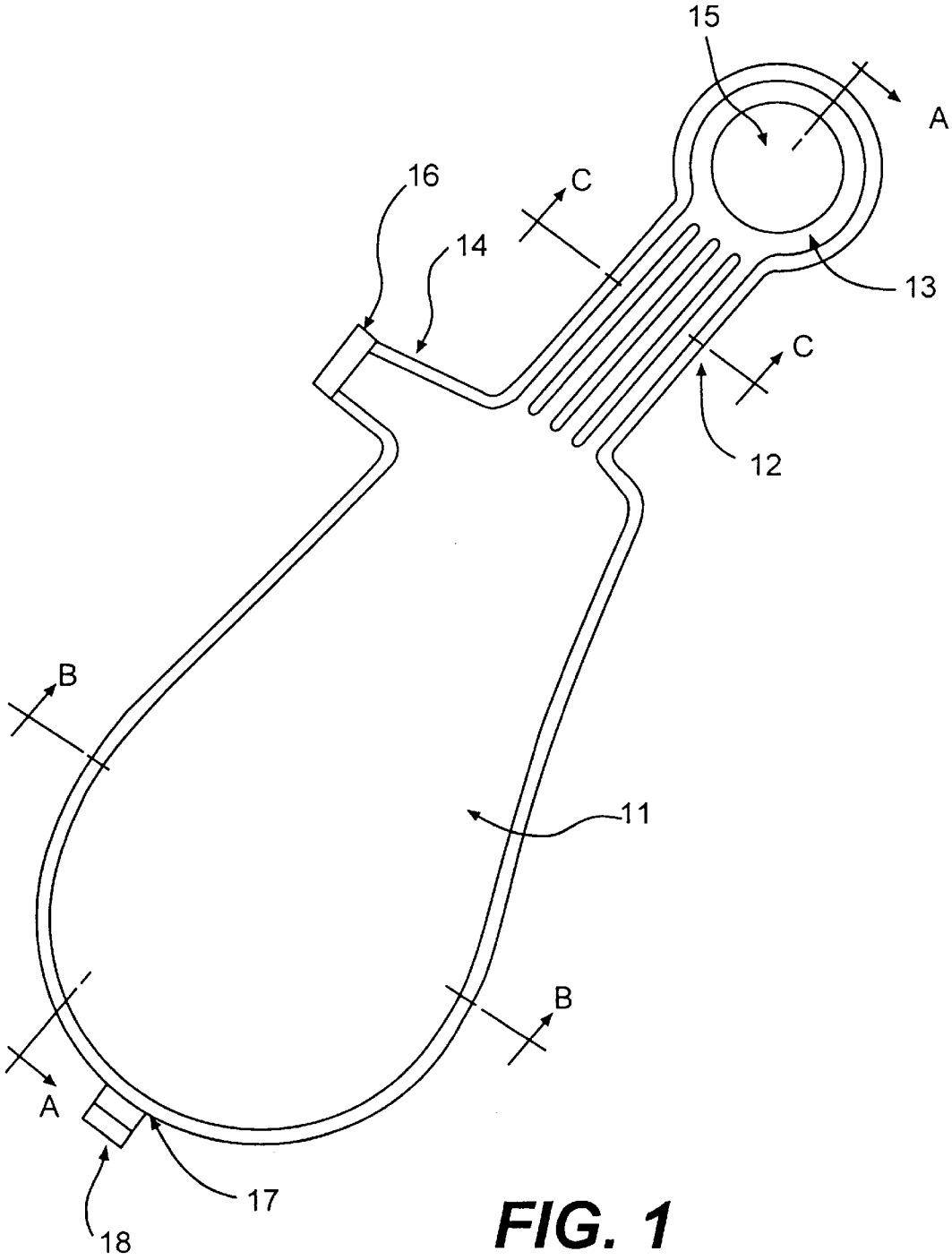
FIG. 1 is a schematic diagram of the plane view of a preferred embodiment of the present invention.

FIG. 1 is a schematic diagram of the plane view of a preferred embodiment of the present invention. It is constructed from a single molded air enclosure having five distinct components: (1) a large collapsible pumping chamber 11, having an elongated wedge-shaped cross-section, tapered towards tie front, and convex peripheral walls that fold together as the chamber is compressed; (2) a forward leading internal air duct 12 fluidly connecting pumping chamber 11 to a valve mounting flange 13; (3) a first non-return valve 15 attached to flange 13 allowing air to flow between the footwear interior and the pumping chamber 11; (4) an external air vent 14 fluidly connected to pumping chamber 11; and (5) a second non-return valve 16 attached to external air vent 14 allowing air to flow to/from pumping chamber 11 from/to the exterior.

Since space under the forefoot is limited, it is preferred that both flange 13 and first non-return valve 15 be thin and flat. External air vent 14 may be threaded to facilitate the installation of exhaust air valve 16. The plane cross-section of pumping chamber 11 closely approximates the size and shape of the rear portion of the footwear into which the present invention is to be incorporated. Pumping chamber 11 has large, relatively flat upper and lower surfaces that can be securely bonded to the footwear components above and below it.

It may be desirable to add a second external air vent 17 with a third non-return valve 18 to facilitate air flow to and from pumping chamber 11. Similarly, to facilitate air flow into or out of pumping chamber 11, flange 13 and non-return valve 15 may be circular (as shown in FIG. 1), or may be oval, elliptical, or rectangular.

In the preferred embodiment of this invention the air enclosure is blow-molded of an impervious resilient material such as a polyurethane or EVA rubber. A wall thickness on the order of 0.5 to 0.8 mm thick is preferred for pumping chamber 11. Thicker walls result in a stiff chamber that resists collapsing while thinner walls provide little resilience or durability. Should the side walls be exposed, the walls may also have to provide a cushioning function. In this case, a thicker wall, up to 2 mm thick, may be desirable.

Figure 2:
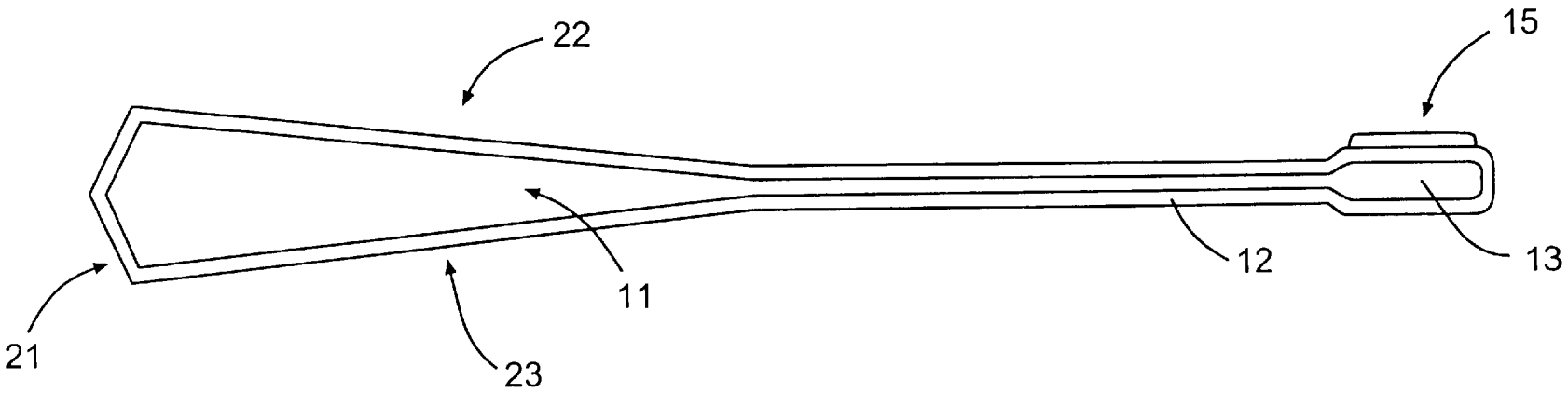
FIG. 2 is a schematic diagram of the longitudinal cross-section of the present invention along Line A—A in FIG. 1.
Figure 2A:
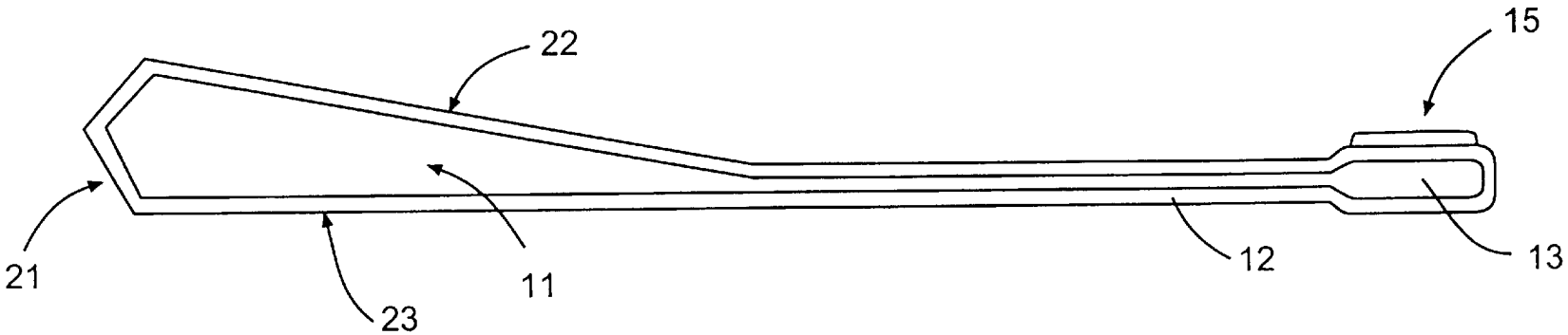

FIG. 2 is a schematic diagram of the longitudinal cross-section of the present invention along Line A—A in FIG. 1.

Figure 3:
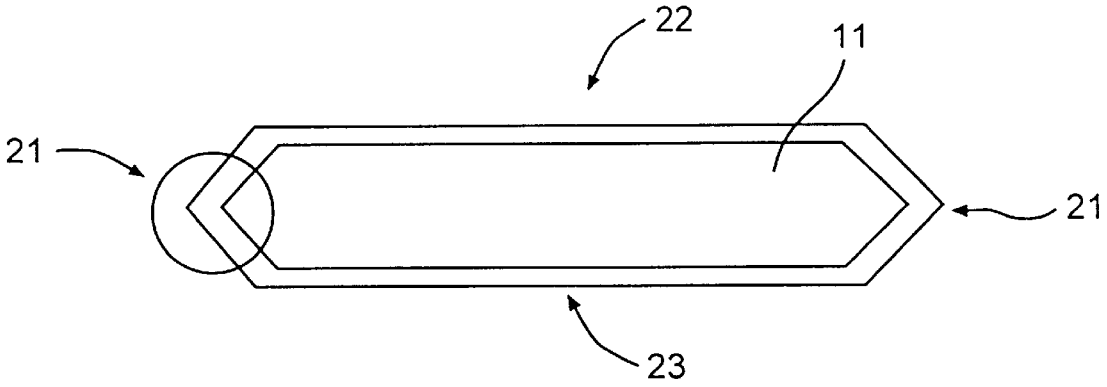
FIG. 3 is a schematic diagram of the lateral cross-section of the pumping chamber of the present invention along Line B—B in FIG. 1.
Figure 3A:
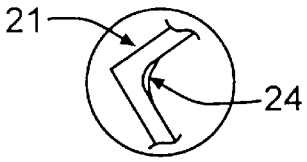
Figure 3B:
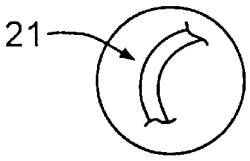

Pumping chamber 11 is wedge-shaped, tapering from a maximum height at its rear to an minimum height at its forward extremity. The upper and lower surfaces 22 and 23, respectively, of pumping chamber 11 are generally flat. The peripheral walls 21, consisting of two side walls and a rear wall, of pumping chamber 11 are convex, allowing them to fold and thus facilitating the collapse. The rear wall portion of peripheral walls 21 has a convex shape forming an elbow-shape cavity with upper and lower surfaces 22 and 23, respectively. The side walls portions of peripheral walls 21 have a similar elbow-shape cavity as shown in FIG. 3.

The combination of the wedge shape with flat upper and lower surfaces and the convex peripheral walls 21 allow pumping chamber 11 to open and close as an efficient bellows pump. A near complete collapse of pumping chamber 11, where the upper surface 22 is in full contact with lower surface 23, maximizes the volume of air circulated in the footwear. In a different embodiment the lower surface 23 may be horizontal as shown in FIG. 2-*a*.

This invention is designed to be placed at the rear of the footwear and to extend forward. The heel contact area of a typical foot is approximately 30% of the length of the foot. By gradually tapering the wedge to its minimum thickness in the mid foot region pressure points, noticeable changes in footbed stiffness are avoided, and wearer comfort is maximized. In order to provide as large an air volume as possible, and to provide a uniform surface under the rear of the foot, pumping chamber 11 of the present invention should be at least 30% of the length of the sole.

During the push-off phase of walking or running, the foot flexes between the metatarsals and phalanges, a point approximately 60% forward of the heel. Soles are often designed to provide a flex zone near the ball of the foot region to ease the effort of walking. The flex zone is subject to high forces and shears that will likely pinch and kink pumping chamber 11. In a preferred embodiment, the wedge-shaped pumping chamber 11 would not extend into the flex zone, i.e., pumping chamber 11 would be less than 60% of its length of the sole.

FIG. 3 is a schematic diagram of the lateral cross-section of the present invention along Line B—B in FIG. 1. The upper and lower surfaces 22 and 23 of pumping chamber 11 are generally flat and horizontal. The convex shape of the side walls portions of peripheral walls 21 are also shown. FIG. 3-*a* shows peripheral walls 21 forming an elbow-shaped cavity with upper surface 22 and lower surface 23. The interior, localized flex points of peripheral walls 21 may be reinforced with fillets 24. In another embodiment of the present invention, peripheral walls 21 may be configured to have a curved cavity as shown in FIG. 3-*b*.

Figure 4:
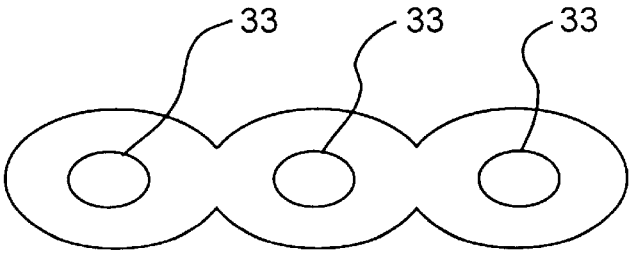
FIG. 4 is a schematic diagram of the lateral cross-section of the forward leading internal air duct portion of the present invention along Line C—C in FIG. 1.

FIG. 4 is a schematic diagram of the lateral cross-section of the forward leading internal air duct 12 of the present invention along Line C—C in FIG. 1. Internal air duct 12 extends from the forward edge of pumping chamber 11 through the flex zone of the footwear and terminates approximately beneath the bridge of the toes. Since internal air duct 12 must pass through the flex zone, it will be subject to repeated bending and possible kinking and pinching. It is therefore desirable to have a low bending moment without restricting air flow. This is achieved by using a thin, wide cross section. Additional resistance to kinking and pinching is achieved by using a plurality of small tubes 33 positioned side by side as the internal air duct 12 connecting the inlet valve to the pumping chamber. The small diameter of tubes 33 allows them to flex without collapsing as they pass through the flex zone. The use a plurality of tubes 33 allows sufficient air movement.

In the preferred configuration, the non-return valves 15 and 16 are configured so as to draw hot moist air into pumping chamber 11 from within the footwear and to exhaust it to the atmosphere. Thus, in the preferred embodiment, the first non-return valve is an inlet valve, and cool dry air from the atmosphere enters into the footwear in the toe or bridge-of-the-toe region, to replace the air that has been pumped into pumping chamber 11. In this configuration, the second non-return valve 16 is an exhaust valve. In an alternative embodiment preferred in cold climates, the valves could be reversed to allow external air to enter pumping chamber 11 through second non-return valve 16. Compressed, heated air can then be pumped into the footwear interior through internal air duct 12 and first non-return valve 15.

External air vent 14 may be positioned anywhere around the side or rear periphery of pumping chamber 11. The central region of the sole, behind the flex zone is subject to the least shear and stress, and is therefore an excellent location for the external air vent 14 as shown in FIG. 1.

In a further preferred embodiment, external air vent 14 uses a removable valve. This removable valve can be replaced should it fail, and could also be removed for cleaning and vacuuming of the pumping chamber.

Figure 5A:
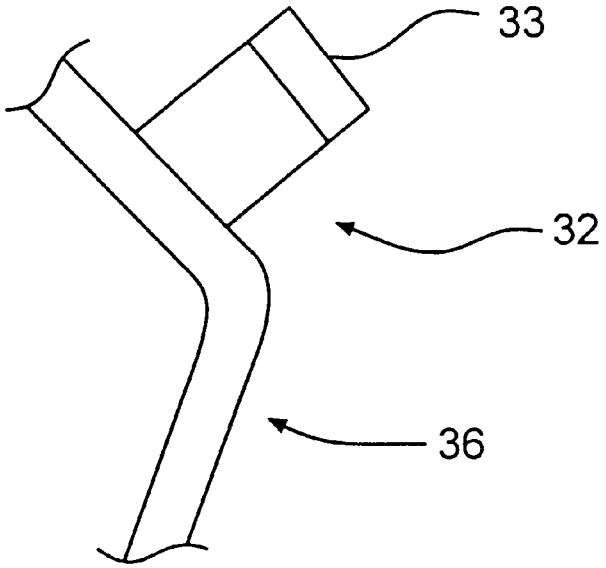
FIG. 5-*a* illustrates a preferred external air vent placement so as not to hinder the collapse of the pumping chamber.
Figure 5B:
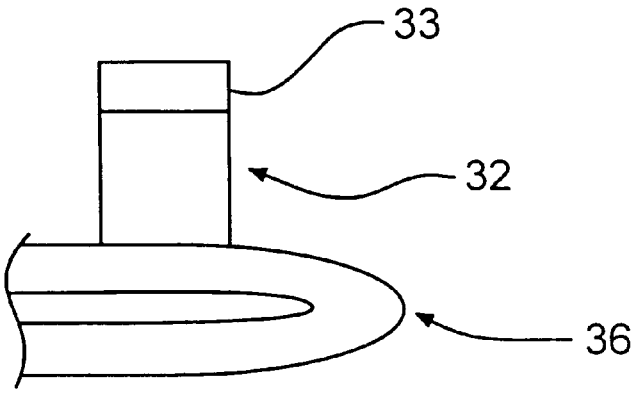

FIG. 5-*a* illustrates an alternative placement of the external air vent 14 in peripheral walls 21 of pumping chamber 11. External air vent 14 is preferably positioned on either the upper or lower sloping surface of peripheral walls 21. In this location, external air vent 14 tilts as peripheral walls 21 fold. Thus, external air vent 14 does not interfere as pumping chamber 11 collapses. On the other hand, placement of external air vent 14 in the center of compressible peripheral walls 21 would inhibit chamber collapse, and create regions of very high stress and potential failure and is therefore not preferable.

Figure 6A:
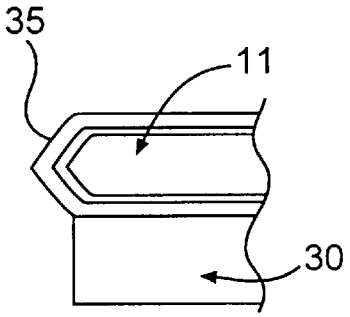
FIG. 6 shows the present invention in place between the footwear upper and the midsole in an athletic footwear.
Figure 6:
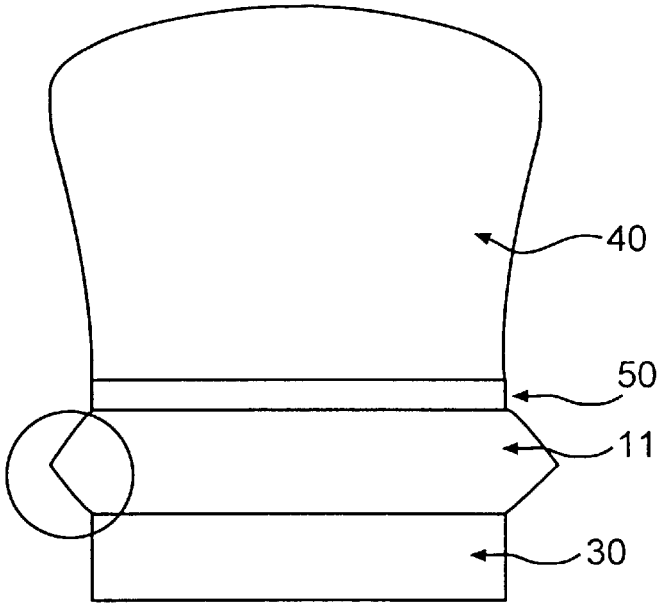

FIG. 6 shows the preferred placement of pumping chamber 11 between foam midsole sole 30 of the footwear and the foot-enclosing upper 40. In this position, the major re-inflation force will result from the tension between the upper 40 and the midsole 30 as the heel of the foot pulls the heel of the footwear off the ground. For cosmetic or manufacturing reasons it may be desirable to enclose the device in a thin layer of midsole material 35 as shown in FIG. 6-*a*.

Figure 7:
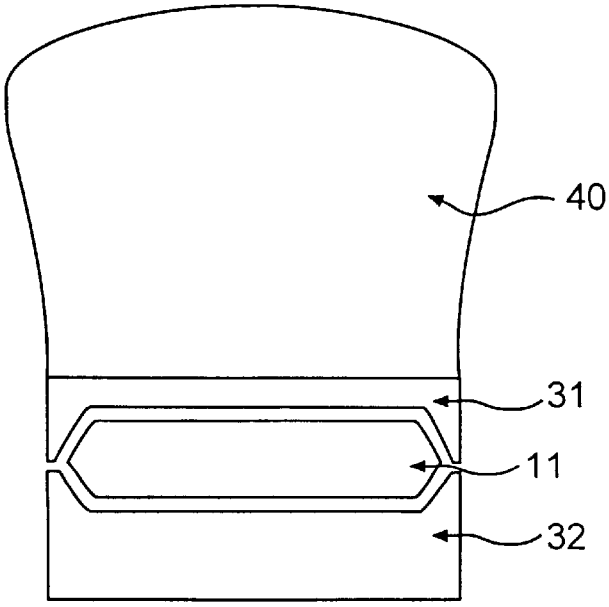
FIG. 7 shows an alternate placement of the present invention in the midsole of the footwear.

Alternatively pumping chamber 11 can be fitted into a cavity in the midsole as shown in FIG. 7. Due to molding requirements, this cavity may be formed as an opening between two layers of foam 31 and 32. In this placement, the resiliency of encapsulating foam will provide additional re-inflation force. In all device placements, the internal air duct 12 and first non-return valve 15 will rest in a channel in the midsole.

The volume of air exchanged with each stride has a significant impact on the level of cooling. For a U.S. size 9 men's footwear, for example, air volumes less than 40 cc are not very effective at cooling the user's foot. With the same footwear, the cooling effect becomes much more effective when pumped air volumes exceed 65 cc. According to U.S. Pat. No. 5,515,622, the maximum workable chamber that can be incorporated into the heel of a U.S. size 9 men's footwear is 20 cc. In the preferred embodiment of this invention, however, pumping chamber 11 has a minimum air capacity of 44 cc plus 3 times the shoe size, i.e., a U.S. size 9 men's footwear would have a minimum pumping chamber volume of 71 cc.

Pumping chamber 11, internal air duct 12, flange 13, and external air vent 14 can be produced cheaply and easily in a single blow-molding operation. The inexpensive non-return valves 15 and 16 can also be attached easily to the flange 13 and external air vent 14 prior to insertion into the footwear. The attachment of non-return valves 15 and 16 can be accomplished by simile screwing or welding operations. The entire system can be tested before it is incorporated into the footwear. The design and manufacture of the upper, outsole, and midsole are largely unaffected by the inclusion of the pumping chamber 11.

Preferably, the design of pumping chamber 11 will be symmetrical, such that a single chamber can be used to make both left and right foot chambers, i.e., the left-foot chamber is the right-foot chamber turned upside down.

Variations on the design of this device will be apparent to those skilled in the art. For example the upper or lower surfaces, or both, of the pumping chamber may be cupped and fitted into a matching depression in the midsole. Under compression the heel will then rest in a shallow cup-like depression which provides more uniform pressure distribution across the shell. This in turn results in greater wearer comfort and also provides a stabilizing centering force to the wearer. The stabilizing force resists ankle twisting, and therefore reduces injuries. It may also be desirable to use multiple exhaust valves to reduce exit air velocity and noise levels.

What I claimed is:

1. A self-ventilating insert having a front end and a rear end, comprising:

(a) a pumping chamber having a wedge-shaped longitudinal cross-section tapering downward from the rear end towards the front end, and a lateral cross-section defined by a top surface, a bottom surface, a left elbow and a right elbow;

(b) an internal air duct having a first end that is fluidly connected to the pumping chamber and a second end that is fluidly connected to a flange near the front end, wherein the internal air duct comprises a plurality of parallel channels;

(c) an external air vent fluidly connected to the pumping chamber at an edge of the pumping chamber, wherein the external air vent extends laterally from the pumping chamber;

(d) a first non-return valve fluidly connected to the internal air duct allowing air to flow through the internal air duct to the pumping chamber; and (e) a second non-return valve fluidly connected to the external air vent allowing air to flow from the pumping chamber to the external air vent, wherein the pumping chamber, the internal air duct, and the external air vent comprise a single molded air enclosure, said single molded air enclosure being symmetrical around a horizontal plane.

2. The insert of claim 1, wherein the insert has a numerical size designation, and wherein the volume of the pumping chamber is at least approximately 44 cubic centimeters plus three times the insert size in cubic centimeters.

3. The insert of claim 1, wherein the pumping chamber has peripheral walls, and wherein the external air vent is located directly on one of the peripheral walls.

4. The insert of claim 3, wherein at least one of the peripheral walls has a convex shape.

5. The insert of claim 1, wherein the pumping chamber having a wall thickness between about 0.5 and about 0.8 mm.

6. The insert of claim 1, wherein the pumping chamber having a wall thickness that is up to about 2 mm.

7. The insert of claim 1, wherein the single molded air enclosure is made of a polyurethane material.

8. The insert of claim 1, wherein the single molded air enclosure is made of ethylenevinyl acetate rubber.

9. A footwear ventilating system for a footwear having a front end, a rear end and a midsole, comprising:

(a) a pumping chamber having relatively flat upper and lower interior surfaces, a wedge-shaped longitudinal cross-section that tapers downwards towards the front end, a lateral cross-section defined by a top surface, a bottom surface, a left elbow and a right elbow, a forward edge, and convex peripheral walls that fold together as the chamber is compressed;

(b) a forward-leading internal air duct having a first end that is fluidly connecting the pumping chamber and a second end that is fluidly connected near the front end to a flange in which in inlet non-return valve is installed, wherein the internal air duct comprises a plurality of parallel channels;

(c) an external air vent fluidly connected to the pumping chamber along its periphery walls, wherein the external air vent extends laterally from the pumping chamber; and (d) an exhaust non-return valve fluidly connecting the external air vent to the pumping chamber, wherein the pumping chamber, the internal air duct, and the external air vent are a single molded air enclosure, said single molded air enclosure being symmetrical around a horizontal plane.

10. The system of claim 9, wherein the footwear has a first length, and wherein the pumping chamber has a second length that is at least 30% of the first length of the footwear but less than 60% of the first length of the footwear.

11. The system of claim 9, wherein the footwear has a numerical size designation, and wherein the volume of the pumping chamber is at least approximately 44 cubic centimeters plus three times the footwear size in cubic centimeters.

12. The system of claim 9, wherein the external air vent is fluidly connected to the forward edge of the pumping chamber near the internal air duct.

13. The system of claim 9, wherein the external air vent is located directly on one of the peripheral walls.

14. An insert for a footwear, said insert having a pumping chamber, comprising:

(a) a wedge-shaped longitudinal cross-section extending downwards towards the front end;

(b) a lateral cross-section defined by a top surface, a bottom surface, a left elbow and a right elbow;

(c) a convex rear wall;

(d) a plurality of parallel channels fluidly connected to the pumping chamber extending from the pumping chamber towards the front end;

(e) an inlet non-return valve fluidly connected to the plurality of parallel channels for drawing air into the plurality of parallel channels as the pumping chamber expands;

(f) an external air vent extends laterally from the pumping chamber; and (g) an exhaust valve fluidly connected to the external air vent for exhausting air out of the pumping chamber as the pumping chamber is compressed, wherein the pumping chamber is a single molded air enclosure, said single molded air enclosure being symmetrical around a horizontal plane.

15. The pumping chamber of claim 14, wherein the pumping chamber is fabricated from an ethylenevinyl acetate material.

16. The pumping chamber of claim 14, wherein the pumping chamber is fabricated from a polyurethane material.

17. A footwear having a front end, a rear end and a midsole, comprising:

(a) a pumping chamber having a wedge-shaped longitudinal cross-section extending downwards towards the front end, a lateral cross-section defined by a top surface, a bottom surface, a left elbow and a right elbow, and a convex rear wall;

(b) a plurality of parallel channels having a first end that is fluidly connected to the pumping chamber and a second end that is fluidly connected to a flange located near the front end;

(c) a first non-return valve fluidly connected to the plurality of parallel channels for allowing air to flow in a first direction with respect to the pumping chamber;

(d) an external air vent extends laterally from the pumping chamber; and (e) a second non-return valve fluidly connected to the external air vent for allowing air to flow in a second direction with respect to the pumping chamber, wherein the pumping chamber, the plurality of parallel channels and the external air vent comprise a single molded air enclosure, said single molded air enclosure being symmetrical around a horizontal plane.

18. The footwear of claim 17, further comprises a flex zone, and wherein the pumping chamber extends from the rear end of the footwear to just before the flex zone.

19. A self-ventilating insert having a front end, a rear end, a first length, and a numerical size designation, comprising:

(a) a pumping chamber having a wedge-shaped longitudinal cross-section tapering downward from the rear end towards the front end, a lateral cross-section defined by a top surface, a bottom surface, a left elbow and a right elbow, wherein the pumping chamber has peripheral walls with a thickness between about 0.5 and about 2 mm, wherein the pumping chamber having a second length that is at least 30% of the first length of the insert but no more than 60% of the first length of the insert, and wherein the volume of the pumping chamber is at least approximately 44 cubic centimeters plus three times the numerical size designation in cubic centimeters;

(b) an internal air duct having a first end that is fluidly connected to the pumping chamber and a second end that is fluidly connected to a flange near the front end, wherein the internal air duct comprises a plurality of parallel channels;

(c) an external air vent fluidly connected to the pumping chamber, wherein the external air vent extends laterally from the pumping chamber;

(d) a first non-return value fluidly connected to the internal air duct allowing air to flow through the internal air duct to the pumping chamber; and (e) a second non-return valve fluidly connected to the external air vent allowing air to flow from the pumping chamber to the external air vent, vent allowing air to flow from the pumping chamber to the external air vent, comprise a single molded air enclosure, said single molded air enclosure being symmetrical around a horizontal plane.

20. The insert of claim 19, wherein the external air vent is located directly on one of the peripheral walls.

21. The insert of claim 19, wherein the single molded air enclosure is made of a polyurethane material.

22. The insert of claim 19, wherein the single molded air enclosure is made of ethylenevinyl acetate rubber.

* * * * *